US005271511A

United States Patent [19]

Daugherty, Jr. et al.

[11] Patent Number: 5,271,511

[45] Date of Patent: Dec. 21, 1993

[54] REMOVABLE SHAFT MEMBER ENGAGEABLE IN A BALL PORTION OF ARTICULATED BEARING ASSEMBLY

[75] Inventors: David W. Daugherty, Jr., Bolingbrook; Wajih Kanjo, Lockport, both of Ill.; Michael G. Hawryszkow, Munster, Ind.

[73] Assignee: Westinghouse Air Brake Company, Wilmerding, Pa.

[21] Appl. No.: 925,604

[22] Filed: Aug. 4, 1992

[51] Int. Cl.[5] ..... B61G 5/00; B61G 5/02

[52] U.S. Cl. ..... 213/75 R; 105/3; 403/152

[58] Field of Search ..... 213/62 R, 75 R, 74, 213/50, 50.5; 105/3, 4.1; 180/134; 280/511; 403/150, 152, 154, 113, 114, 117

[56] References Cited

U.S. PATENT DOCUMENTS

| | | | |
|---|---|---|---|
| 737,360 | 8/1903 | Daly | 403/154 |
| 913,758 | 3/1909 | Van Auken | 403/154 |
| 2,013,546 | 9/1935 | Wallace | 105/3 |
| 2,286,590 | 6/1942 | Van Dorn | 213/50 X |
| 3,525,448 | 8/1970 | Bauer | 403/57 |
| 3,716,146 | 2/1973 | Altherr | 213/75 R |
| 4,243,192 | 1/1981 | Johnson | 403/131 X |
| 4,258,628 | 3/1981 | Altherr | 213/75 R X |
| 4,593,829 | 6/1986 | Altherr | 213/75 R |
| 4,867,071 | 9/1989 | Weber | 105/4.1 |
| 5,042,393 | 8/1991 | Kanjo et al. | 213/75 R X |
| 5,131,331 | 7/1992 | Lynch, Jr. et al. | 213/75 R X |

FOREIGN PATENT DOCUMENTS

| | | | |
|---|---|---|---|
| 1176366 | 1/1970 | United Kingdom | 213/75 R |

*Primary Examiner*—Robert J. Oberleitner
*Assistant Examiner*—S. Joseph Morano
*Attorney, Agent, or Firm*—J.O.R.

[57] ABSTRACT

A bearing assembly having a removable shaft member. The shaft member has a center portion is designed such that rotation of the ball portion of the bearing assembly on the center portion is prevented. A first end portion extends outwardly from one end of the center portion and has a diameter substantially equal to an arcuate portion formed in a first side wall portion of a cavity located at one end of the female connection member. A flat face portion engageable by a wedge member is provided on the first end portion. A locking device is engageable with the first end portion to secure the ball portion against lateral movement in a first direction. A second end portion extends outwardly from the other end of the center portion and has a diameter also substantially equal to a diameter of an arcuate portion in a second side wall portion of the cavity. A flat face is formed on the second end portion which is engageable by another wedge member, thereby securing the male member to the female connection member. Another locking device is engageable on the second end portion to prevent the ball portion of the bearing assembly to prevent lateral movement in a second direction.

22 Claims, 3 Drawing Sheets

REMOVABLE SHAFT MEMBER ENGAGEABLE IN A BALL PORTION OF ARTICULATED BEARING ASSEMBLY

FIELD OF THE INVENTION

The present invention relates, in general, to an articulated coupling arrangement used to connect adjacent predetermined ends of a pair of railway cars together in a substantially semipermanent manner and, more particularly, this invention relates to a removable shaft member engageable in the ball portion of the bearing assembly portion of the railway car articulated coupling arrangement.

BACKGROUND OF THE INVENTION

Prior to the development of the present invention, it is well known in today's modern railroad industry that standard couplers are used to connect adjacently disposed ends of a pair of railway cars together. Further, on any of these railway cars which may possibly be used in interchange type service, these standard couplers must have received approval by the Association of American Railroads (AAR) prior to their being installed on such adjacently disposed ends of the railway cars. This being the case so that a proper connection of the cars is ensured.

It is generally well recognized, in the railroad industry, that such couplers will normally be required to serve a number of important functions in this application. For example, standard couplers are used to facilitate the connecting and the unconnecting of individual railway cars to and from, respectively, a train consist. Another function served by these standard couplers is that they enable such individual railway cars to more easily negotiate the curved and hilly portions of the track which will be encountered during operation of the train on the track structure. Additionally, such standard couplers perform the function of allowing such railway cars to be more easily and readily combined, thereby making up a train consist. These standard couplers further permit such adjacently disposed ends of the railway cars to be easily and readily separated into individual cars as necessary for either loading or unloading cargo thereto or therefrom, respectively.

In more recent times, however, in the railroad industry it has come to be generally recognized that a significant number of relative important advantages can be achieved by the interconnection of a number of railway cars to form a substantially semipermanent unit. This has been particularly the situation, for example, where such railway cars are specifically designed for use in what is commonly referred to in the railroad industry as "piggyback" or intermodal service. One of the primary reasons for this is that the cargo to be transported is either brought to or removed from, respectively, predetermined central locations. Generally, such central locations are usually owned and operated by the railroads. This cargo is normally either over-the-road trailers or large containers which usually are used to ship cargo by oceangoing vessels.

The individual railway cars which have been connected together in this substantially semipermanent manner are commonly known in the railroad industry as either a "5-pack" or as a "10-pack" unit. Except at the extreme outermost ends of each 5 or 10-pack unit, the use of such standard couplers discussed above is not required on these 5 or 10-pack units. Because of their dedicated service, breaking of these 5 or 10-pack units will normally occur only when some maintenance must be carried out on either an individual coupler component or on certain other critical components positioned on the railway car which will require an individual car to be removed from such 10-pack unit on a temporary basis. In the railroad industry, it has become quite obvious that with the use of some type of semipermanent coupling arrangement it is possible for them to achieve a rather significant reduction in both their operating and maintenance costs. These cost reductions can be attributed to a variety of reasons. At a minimum, these reasons include a significant reduction in the weight of the railway equipment. Such weight reduction translates into a rather significant reduction in the amount of energy required to move a train consist over the track structure. Because, in these semipermanent coupling arrangements fewer railway trucks and draft gear assemblies are required, there is not only a reduction in equipment costs achieved but this also results in a substantial reduction in the maintenance requirements.

Now, however, with the relatively extensive use of such substantially semipermanent coupling arrangement, the railroad industry in conjunction with the railway equipment suppliers have determined that it is of critical importance for a close-buttoned relationship to be maintained between the couplers draft components present in a particular coupling arrangement. Further contributing to the importance of this close-buttoned relationship requirement is the ever increasing loads which must be carried by modern railway cars and train consists in order for the railroads to be competitive with other modes of cargo transport. This close-buttoned relationship has been found necessary, for example, so that the detrimental effects of the impact forces, which are normally encountered during make-up and in-track train operation, can be reduced to an acceptable level. In this manner, the possible damage that could be incurred by the cargo and/or the railway equipment can be held to an absolute minimum. Such impact forces are generally encountered during normal buff operation of the train consist.

With the above discussion in mind, attention is now directed to a particular prior art type articulated coupling arrangement used for the purpose of connecting adjacently disposed ends of a pair of railway cars together in such semi-permanent fashion. This prior art articulated coupling arrangement is taught in U.S. Pat. No. 4,258,628. As has been illustrated therein, this particular articulated coupling apparatus includes both a male connection member and a female connection member. The male connection member is secured at one end thereof to one end of a first railway car center sill member and the female connection member is secured at one end thereof to an adjacent end of a second railway car center sill member.

The female connection member, in this prior art coupling arrangement, is rotatably engaged in a center plate bowl portion of the bolster member positioned intermediate the side frames of the railway truck member. Such rotatable-type engagement is accomplished in a manner that is generally well known in the railway art. The outer end portion of the male connection member is disposed for relative movement at the outer end portion of such female connection member.

A pin member is utilized in this articulated coupling arrangement to connect together the outer end portion of the male connection member within the cavity of such female connection member, thereby forming such substantially semipermanent coupling. This pin member is positioned in a vertical plane. Additionally, this pin member is positioned in aligned apertures which are formed in each of such male connection member and such female connection member. It is of significance to note that, as is taught in this prior art reference, the aperture formed in such male connection member for receiving such pin member therein must be formed somewhat larger than such pin member itself. In this coupling arrangement, this is necessary to permit certain movements that are required of the coupling apparatus during service to be achieved.

It should additionally be noted that a rear surface portion of such apertures formed in such male connection member and which will receive such pin member therein includes a horizontally disposed concave configuration and a vertically disposed convex configuration. This particular configuration is desirable in this coupling arrangement in order for both the male connection member and the female connection member to be able to move in each of a horizontal direction and a vertical direction with respect to one another. Another substantial area of surface contact between the rear surface of such aperture and the pin member itself is provided by this configuration at the same time.

Such male connection member, adjacent the outer end surface of the outer end portion thereof, includes a convex configuration. This convex configuration on the outer end surface of such male connection member abuttingly engages a complimentary concave surface which is formed on a front face portion of a follower member.

As illustrated, in this coupling arrangement, this follower member is disposed within the rear portion of such cavity located in the outer end portion of such female connection member. This follower member, on the rear face portion thereof, includes a pair of vertically disposed slot-like cavities formed therein. A first portion of a resilient member is positioned within each of these vertically disposed slot-like cavities. Each such resilient member includes a second portion which extends outwardly from the rear face portion of such follower member.

In this manner, a vertically disposed wedge-like element can be engaged with the exposed outermost surface area of such resilient element. Such wedge-like element being a necessary component so that during service of this coupling arrangement such follower member and the male connection member can be urged forwardly. Consequently, the rear surface portion of the aperture formed in such outer end portion of the male connection member will be maintained substantially in mating engagement with such pin member at all times.

In this coupling arrangement, because the majority of the articulated connection members used are normally manufactured as cast components, such mating engagement being maintained between such pin member and the rear surface portion of this aperture disposed in the male connection member is essential. Furthermore, in attempting to maintain the manufacturing costs of this coupling arrangement as low as possible, such cast connecting components will normally receive very little, if any, finish machining necessary to provide either the required or the desirable dimensional control. In other words, these cast connecting members will generally be used in an as cast condition. As a result of this manufacturing cost-saving practice, it is quite often difficult to provide an articulated coupling apparatus that will be self-adjusting under the various wear conditions which such coupling apparatus will normally be subjected to during operation. It is important, nevertheless, to minimize as much as possible the slack encountered in the various coupling connections during such in track service of the coupling arrangement.

Other prior, art type coupling devices are taught in U.S. Pat. No. 3,716,148 and Canadian Patent Number 1,231,078.

SUMMARY OF THE INVENTION

The present invention provides a removable shaft member which is engageable in a ball portion of a bearing assembly. This bearing assembly is, in turn, engageable in an outer end portion of a male connection member of an articulated coupling arrangement. Such articulated coupling arrangement being used to connect adjacently disposed predetermined ends of a pair of railway cars together in a substantially semipermanent manner. The removable shaft member being further engageable with a pair of radially opposed side wall portions of a cavity formed in an outer end portion of a female connection member associated with the articulated coupling arrangement. The removable shaft member includes a center portion having each of a first predetermined length and a first predetermined diameter adjacent a first end of such center portion. This center portion has a second predetermined diameter adjacent an axially opposed second end thereof. The center portion of such removable shaft member is engageable in an aperture formed through the ball portion of such bearing assembly. A first means is disposed on the center portion of such shaft member substantially parallel to the longitudinal axis thereof. This first means prevents the ball portion of the bearing assembly from rotating on the center portion of such shaft member. There is a first end portion extending outwardly from the first end of such center portion of the removable shaft member. This first end portion includes each of a second predetermined length and a third predetermined diameter. Such third predetermined diameter being substantially equal to a diameter of an arcuate portion formed in a first side wall portion of the cavity located in the outer end portion of the female connection member. There is a first substantially flat face portion formed along at least a portion of the second predetermined length of such first end portion. This first flat face portion being engageable by a substantially flat face of a wedge member thereby enabling securement of the male connection member to the female connection member. A portion of a second means is formed on the first end portion of such removable shaft member which cooperation with another portion of the second means to enable the ball portion of the bearing assembly to be secured against lateral movement in a first predetermined direction during operation of the articulated coupling arrangement. A second end portion extends outwardly from the second end of such center portion of the removable shaft member. This second end portion includes each of a third predetermined length and a fourth predetermined diameter. Such fourth predetermined diameter being substantially equal to a diameter of an arcuate portion formed in a second side wall portion of such cavity. A second substantially flat face is formed along at least a portion of such third predetermined length of this second end portion. The second flat face portion being engageable by a substantially flat face of a another wedge member thereby enabling securement of the male connection member to the female connection member. The final essential element of the removable shaft member is a portion of a third means formed on the second end portion of such removable shaft member which cooperates with another portion of the third means to enable the ball portion of the bearing assembly to be secured against lateral movement in a second predetermined direction during operation of the articulated coupling arrangement.

OBJECTS OF THE INVENTION

It is, therefore, one of the primary objects of the present invention to provide a removable shaft member for the bearing assembly portion of an articulated coupling arrangement thereby minimizing repair cost.

Another object of the present invention is to provide a removable shaft member for the bearing assembly portion of an articulated coupling arrangement having an extended shaft portion on each side of the ball portion in order to provided a more stable connection to the railway car.

Still another object of the present invention is to provide a removable shaft member for the bearing assembly portion of an articulated coupling arrangement which includes means for preventing lateral movement and rotational movement of the ball portion of such bearing assembly.

Yet another object of the present invention is to provide a removable shaft member for the bearing assembly portion of an articulated coupling arrangement which is capable of withstanding at least one million pounds of force being exerted thereon.

A further object of the present invention is to provide a removable shaft member for the bearing assembly portion of an articulated coupling arrangement which is relatively easy to assemble and disassemble.

In addition to the various objects and advantages of the removable shaft member described above, various other objects and advantages of the present invention will become more readily apparent to those persons who are skilled in the railway coupling art from the following more detailed description of the invention, particularly, when such description is taken in conjunction with the attached drawing figures and with the appended claims.

Figure 1:
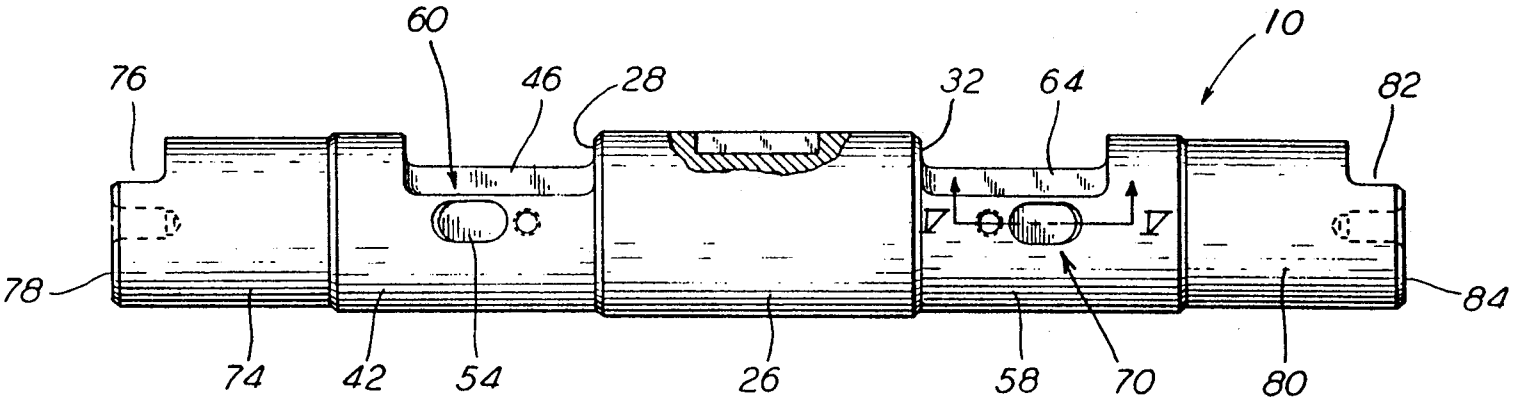
FIG. 1 is a side elevation view illustrating a presently preferred embodiment of the removable shaft member for a bearing assembly portion of an articulated coupling system.

DESCRIPTION OF THE PRESENTLY PREFERRED AND ALTERNATIVE EMBODIMENTS OF THE INVENTION

Prior to proceeding to the more detailed description of the removable shaft member according to the instant invention, it should be noted that, for the sake of clarity, identical components having identical functions have been identified with identical reference numerals throughout the several views illustrated in the drawings.

Figure 2:
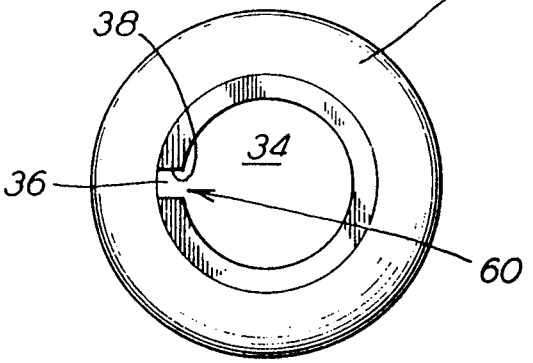
FIG. 2 is a side elevation view of a presently preferred embodiment of the ball portion of the bearing assembly for an articulated coupling arrangement.
Figure 3:
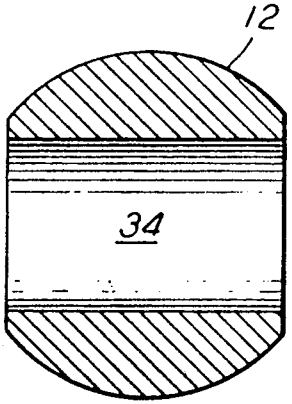
FIG. 3 is an elevation view, partially in cross section, of the ball portion of the bearing assembly.
Figure 4:
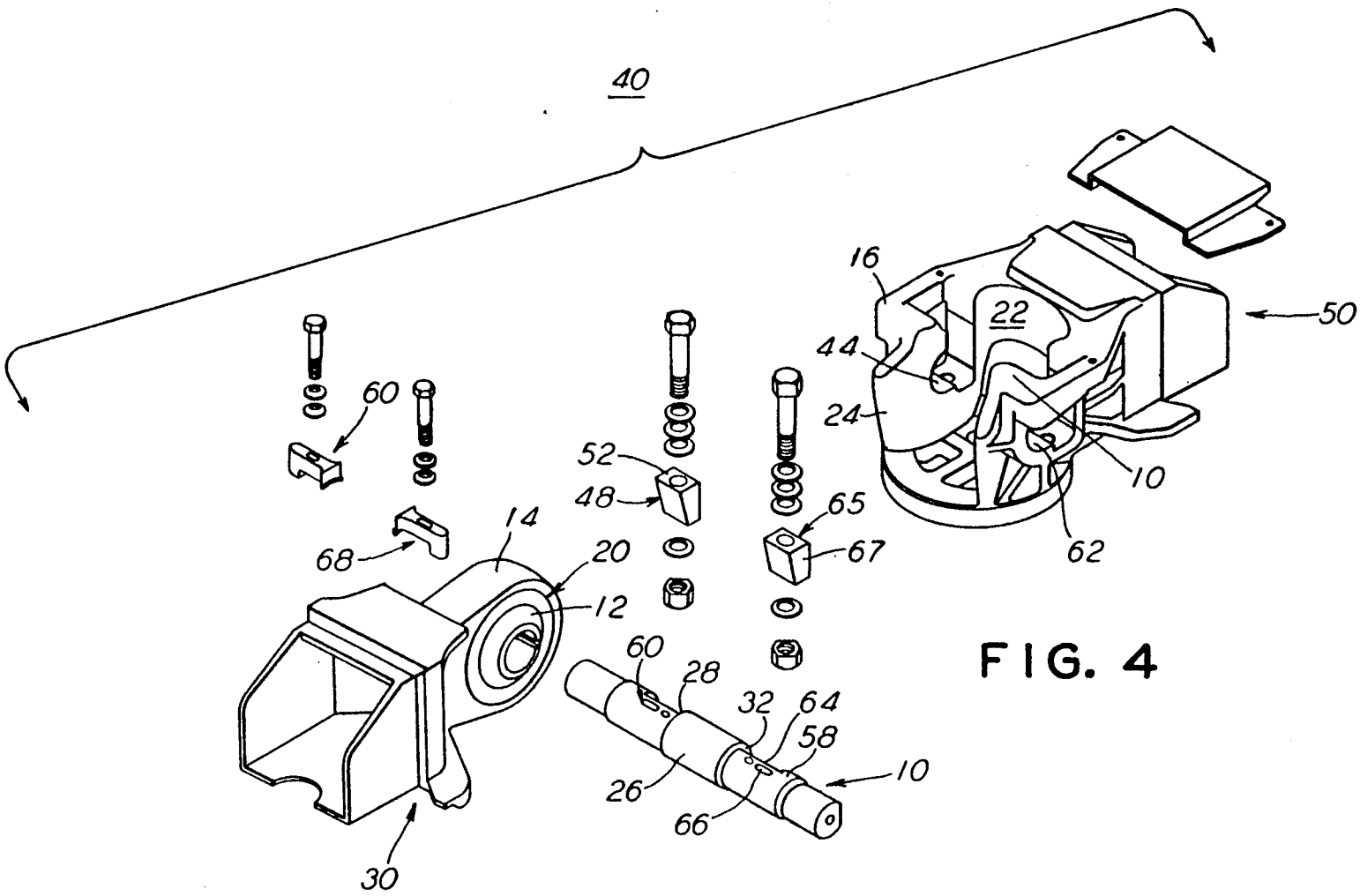
FIG. 4 is an exploded view of an articulated coupling arrangement utilizing the removable shaft member of the present invention.
Figure 7:
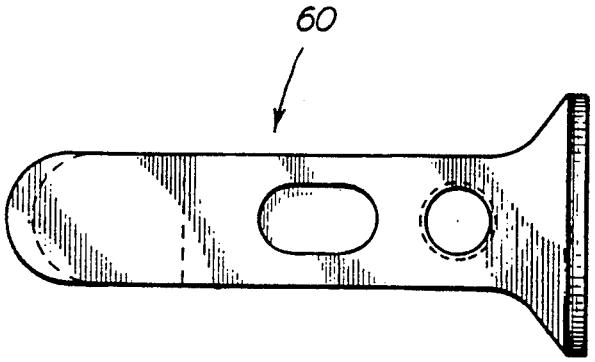
FIGS. 6, 7 and 8 illustrate another portion of a presently preferred means for securing the ball portion of the bearing assembly against lateral movement.

Now reference is made, more particularly, to FIGS. 1 and 4. Illustrated therein is a removable shaft member, generally designated 10, which is engageable in a ball portion 12 of a bearing assembly, generally designated 20. Such bearing assembly 20 is engageable in an outer end portion 14 of a male connection member, generally designated 30, of an articulated coupling arrangement, generally designated 40. The articulated coupling arrangement 40 being used to connect adjacently disposed predetermined ends (not shown) of a pair of railway cars (not shown) together in a substantially semipermanent manner. The removable shaft member 10 being further engageable with a pair of radially opposed side wall portions 16 and 18 of a cavity 22 formed in an outer end portion 24 of a female connection member, generally designated 50, of such articulated coupling arrangement 40. The removable shaft member 10 includes a center portion 26 which has each of a first predetermined length and a first predetermined diameter adjacent a first end 28 thereof and a second predetermined diameter adjacent a second end 32 thereof. Such center portion 26 is engageable in an aperture 34 (FIGS. 2 and 3) formed through the ball portion 12 of the bearing assembly 20. In the presently preferred embodiment, one of such first predetermined diameter and such second predetermined diameter of the center portion 26 of the removable shaft member will be slightly less than an opposite one of such first predetermined diameter and such second predetermined diameter. In this manner a predetermined taper is provided on an outer surface of the center portion 26 of the removable shaft member 10. In this manner, lateral movement, in one direction, of the ball portion 12 and the center portion 26 of the shaft member 10 is more or less prevented. Additionally, in the preferred embodiment, the first predetermined length of the center portion 26 of such removable shaft member 10 will be between about 7.60 inches and about 7.80 inches.

There is a first means, generally designated 60, (FIG. 2) disposed on the center portion 26 of the removable shaft member 10 which extends substantially parallel to a longitudinal axis of the removable shaft member 10 for preventing rotation of such ball portion 12 of the bearing assembly 20 on the center portion 26 of the removable shaft member 10. In the presently preferred embodiment, such first means 60 disposed on the center portion 26 of the removable shaft member 10 is at least one of a raised portion 36 and a groove portion (not shown) which can be matingly engaged with at least one of a groove portion 38 and a raised portion (not shown), respectively, formed adjacent a surface of such aperture 34 formed in the ball portion 12. The most preferred means 60 disposed on the center portion 26 of the removable shaft member 10 is a raised portion 36 that matingly engages with the groove portion 38 formed adjacent the surface of such aperture 34 formed in the ball portion 12.

Removable shaft member 10 further includes a first end portion 42 which extends outwardly from the first end 28 of the center portion 26. First end portion 42 having each of a second predetermined length and a third predetermined diameter. Such third predetermined diameter being substantially equal to a diameter of an arcuate portion 44 formed in a first side wall portion 16 of the cavity 22. In the presently preferred embodiment of the invention, the second predetermined length of such first end portion 42 will be at least about 4.50 inches and a more preferred length between at least about 4.50 inches and about 6.33 inches. It is also presently preferred that the third predetermined diameter of such first end portion 42 of the removable shaft member 10 is between about 4.370 inches and about 4.375 inches.

There is a first substantially flat face portion 46 formed along at least a portion of the second predetermined length of such first end portion 42. The first flat face portion 46 being engageable by a substantially flat face 48 (FIG. 4) of a wedge member 52 thereby, enabling -securement of the male connection member 30 to the female connection member 50. The length of the first flat face portion 48 on the first end portion 42 is preferably between about 4.40 inches and about 4.60 inches. A second means, generally designated 60, having a first portion 54 formed on the first end portion 42 of the removable shaft member 10 and a second portion 56 engageable with the first portion 54, is provided for enabling the ball portion 12 of the bearing assembly 20 to be secured against lateral movement in a first predetermined direction during operation of the articulated coupling arrangement 40.

Extending outwardly from the second end 32 of the center portion 26 of such removable shaft member 10 is a second end portion 58. The second end portion 58 has both a third predetermined length and a fourth predetermined diameter. Such fourth predetermined diameter being substantially equal to a diameter of an arcuate portion 62 formed in the second side wall portion 18 of the cavity 22.

The third predetermined length, in the presently preferred embodiment of the invention, of such second end portion 58 will be at least about 4.50 inches and within a range of between at least about 4.50 inches and about 6.33 inches. Further the fourth predetermined diameter of such second end portion 58 of the removable shaft member 10 will preferably be between about 4.370 inches and about 4.375 inches.

In the embodiment of the invention being described, there is a second substantially flat face 64 formed along at least a portion of such third predetermined length of the second end portion 58. This second flat face portion 64 is engageable by a substantially flat face portion 65 of a wedge member 67 thereby enabling securement of such male connection member 30 to such female connection member 50.

The second flat face portion 64 of such second end portion 58 is preferably between about 4.40 inches and about 4.60 inches in length. In a more preferred embodiment of the invention, each of the second predetermined length of the first end portion 42 and the third predetermined length of the second end portion 58 will be between about 4.50 inches and about 6.33 inches. Additionally in the preferred embodiment each of the third predetermined diameter of such first end portion 42 and the fourth predetermined diameter of such second end portion 58 will be between about 4.370 inches and about 4.375 inches. Preferably, also, the first flat face portion 46 of the first end portion 42 and the second flat face portion 64 on the second end portion 58 will be between about 4.40 inches and about 4.60 inches in length.

Figure 8:
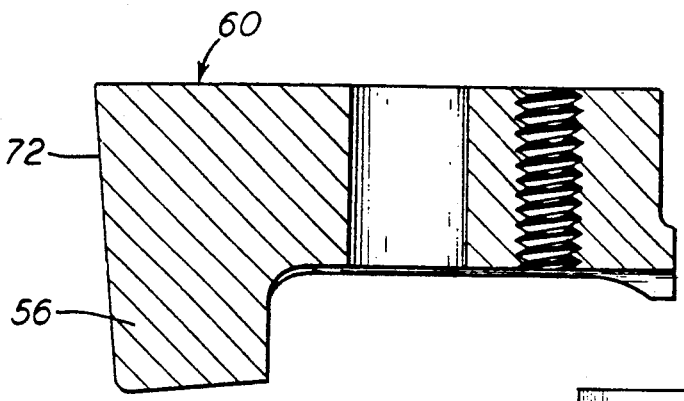
Figure 6:
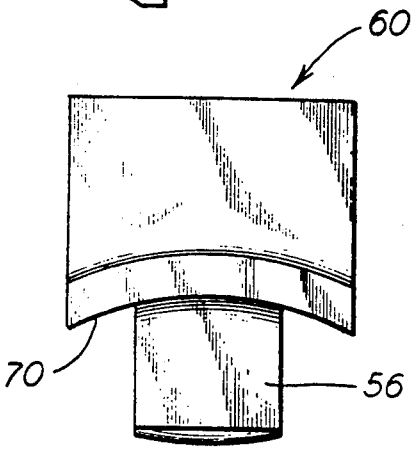
Figure 5:
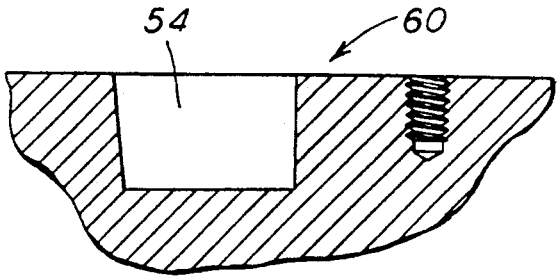
FIG. 5 is an enlarged view of the removable shaft member illustrating a portion of the means for securing the ball portion of a bearing assembly against lateral movement.

According to the most preferred embodiment of the invention there is a third means, which is a mirror image of the second means 60, which has a first portion 66 formed on such second end portion 58 of the removable shaft member 10 and a second portion 68 engageable with such first portion 66 which enables the ball portion 12 of the bearing assembly 20 to be secured against lateral movement in a second predetermined direction during operation of the articulated coupling arrangement 40. As can be seen in FIG. 6, the second portion of the first and second means 60 for securing the ball portion 12 against lateral movement includes an arcuate shaped surface 70 having a radius substantially identical to the radius of the first end portion 42 and the second portion 58 of the removable shaft member 10. As can be seen in FIG. 8, the second portion of the second and third means 60 includes a tapered wall portion 72 which assures that a tight fit against the surface of the ball portion 12 is achieved when such second portion of the second and third means is engaged in the first portion of such second and third means 60.

As shown in FIG. 4, the second means includes a first elongated aperture having a first tapered end wall facing a first end of the center portion of the shaft member and a first threaded aperture formed intermediate another end wall of the first elongated aperture and the first end of the center portion of the shaft member. The first elongated aperture receives a portion of a first ball portion locking device therein, and the first threaded aperture receives a first bolt member therein to secure the first locking device to the first end portion of the shaft member. Similarly, the third means includes a second elongated aperture having a second tapered end wall facing a second end of the center portion of the shaft member and a second threaded aperture formed intermediate another end wall of the second elongated aperture and the second end of the center portion of the shaft member. The second elongated aperture receives a portion of a second ball portion locking device therein, and the second threaded aperture receives a second bolt member therein to secure the second locking device to the second end portion of the shaft member.

In order to provide maximum stability it is presently preferred that the removable shaft member 10 will include a first shaft extension portion 74 having each of a fourth predetermined length and a fifth predetermined diameter. Such first shaft extension portion 74 extends outwardly from an outer end of the first end portion 42 and includes a substantially flat face portion 76. This flat face portion 76 has a first predetermined width disposed adjacent an outer end 78 thereof. Also the removable shaft member 10 includes, in this preferred embodiment, a second shaft extension portion 80 which has a fifth predetermined length and a sixth predetermined diameter. Such second shaft extension portion 80 extends outwardly from an outer end of the second end portion 58 and has a substantially flat face portion 82 disposed adjacent an outer end 84 thereof. In a most preferred embodiment at least one of such first shaft extension portion 74 and the second shaft extension portion 80 includes a threaded aperture formed in an outer face thereof and substantially centered at a longitudinal axis of the removable shaft member 10. This enables rotation of the ball within the race assembly to assist in assembly and disassembly of the coupling.

While a member of the presently preferred and alternative embodiments of the removable shaft member, according to the present invention, have been described in considerable detail above, it should be understood that those persons who are skilled in the railway coupling art can make various other modifications and adaptations of the present invention without departing from the spirit and scope of the appended claims.

We claim:

1. A removable shaft member engageable in a ball portion of a bearing assembly which is engageable in an outer end portion of a male connection member of an articulated coupling arrangement used to connect adjacent predetermined ends of a pair of railway cars together in a substantially semipermanent manner, said removable shaft member being further engageable with a pair of radially opposed side wall portions of a cavity formed in an outer end portion of a female connection member of such articulated coupling arrangement, said removable shaft member comprising:

(a) a center portion having each of a first predetermined length and a first predetermined diameter adjacent a first end of said center portion and a second predetermined diameter adjacent a second end of said center portion, said center portion being engageable in an aperture formed through such ball portion of such bearing assembly;

(b) a first means disposed on said center portion of said shaft member and extending substantially parallel to a longitudinal axis of said shaft member for preventing rotation of such ball portion of such bearing assembly on said center portion of said shaft member;

(c) a first end portion having each of a second predetermined length and a third predetermined diameter extending outwardly from said first end of said center portion of said shaft member, said third predetermined diameter being substantially equal to a diameter of an arcuate portion formed in a first side wall portion of such cavity;

(d) a first substantially flat face portion formed along at least a portion of said second predetermined length of said first end portion, said flat face portion being engageable by a substantially flat face of a wedge member thereby enabling securement of such male connection member to such female connection member;

(e) a second means, having a first portion formed on said first end portion of said shaft member and a second portion engageable with said first portion, for preventing lateral movement of such ball portion of such bearing assembly in a first predetermined direction during operation of such articulated coupling arrangement;

(f) a second end portion having each of a third predetermined length and a fourth predetermined diameter extending outwardly from said second end of said center portion of said shaft member, said fourth predetermined diameter being substantially equal to a diameter of an arcuate portion formed in a second side wall portion of such cavity; and (g) a second substantially flat face formed along at least a portion of said third predetermined length of said second end portion, said second flat face portion being engageable by a substantially flat face of a wedge member thereby enabling securement of such male connection member to such female connection member.

2. A removable shaft member, according to claim 1, wherein said removable shaft member further includes a third means having a first portion formed on said second end portion of said shaft member and a second portion engageable with said first portion for preventing lateral movement of such ball portion of such bearing assembly in a second predetermined direction during operation of such articulated coupling arrangement.

3. A removable shaft member, according to claim 1, wherein one of said first predetermined diameter and said second predetermined diameter of said center portion of said shaft member is slightly less than an opposite one of said first predetermined diameter and said second predetermined diameter thereby providing a predetermined taper on an outer surface of said center portion of said shaft member.

4. A removable shaft member, according to claim 3, wherein said first predetermined length of said center portion of said shaft member is between about 7.60 inches and about 7.80 inches.

5. A removable shaft member, according to claim 4, wherein said first means disposed on said center portion of said shaft member is a raised portion which can be matingly engaged with a groove portion formed adjacent a surface of such aperture in such ball portion.

6. A removable shaft member, according to claim 5, wherein said first portion of said second means formed on said first end portion of said shaft member for preventing lateral movement of such ball portion of such bearing assembly in such first predetermined direction includes a first elongated aperture having a first tapered end wall disposed facing said first end of said center portion of said shaft member and a first threaded aperture formed intermediate another end wall of said first elongated aperture and said first end of said center portion of said shaft member, said first elongated aperture receiving a portion of a first ball portion locking device therein and said first threaded aperture receiving a first bolt member therein to secure such first locking device to said first end portion of said shaft member and wherein said first portion of said third means formed on said second end portion of said shaft member for preventing lateral movement of such ball portion of such bearing assembly in such second predetermined direction includes a second elongated aperture having a second tapered wall disposed facing said second end of said center portion of said shaft member and a second threaded aperture formed intermediate another end wall of said second elongated aperture and said second end of said center portion of said shaft member, said second elongated aperture receiving a portion of a second ball portion locking device therein and said second threaded aperture receiving a second bolt member therein to secure such second locking device to said second end portion of said shaft member.

7. A removable shaft member, according to claim 4, wherein each of said second predetermined length of said first end portion and said third predetermined length of said second end portion is between at least about 4.50 inches and about 6.33 inches.

8. A removable shaft member, according to claim 7, wherein each of said third predetermined diameter of said first end portion and said fourth predetermined diameter of said second end portion is between about 4.370 inches and about 4.375 inches.

9. A removable shaft member, according to claim 8, wherein each of said first flat face portion on said first end portion and said second flat face portion on said second end portion is between about 4.40 inches and about 4.60 inches in length.

10. A removable shaft member, according to claim 1, wherein said first means disposed on said center portion of said shaft member is at least one of a raised portion and a groove portion which can be matingly engaged with at least one of a groove portion and a raised portion, respectively, formed adjacent a surface of such aperture in such ball portion.

11. A removable shaft member, according to claim 1, wherein said second predetermined length of said first end portion is at least about 4.50 inches.

12. A removable shaft member, according to claim 11, wherein said second predetermined length of said first end portion is between at least about 4.5 inches and about 6.33 inches.

13. A removable shaft member, according to claim 12, wherein said third predetermined diameter of said first end portion of said shaft member is between about 4.370 inches and about 4.375 inches.

14. A removable shaft member, according to claim 13, wherein said first flat face portion on said first end portion is between about 4.40 inches and about 4.60 inches in length.

15. A removable shaft member, according to claim 14, wherein said third predetermined length of said second end portion is at least about 4.50 inches.

16. A removable shaft member, according to claim 15, wherein said third predetermined length of said second end portion is between at least about 4.50 inches and about 6.33 inches.

17. A removable shaft member, according to claim 16, wherein said fourth predetermined diameter of said second end portion of said shaft member is between about 4.370 inches and about 4.375 inches.

18. A removable shaft member, according to claim 17, wherein said second flat face portion of said second end portion is between about 4.40 inches and about 4.60 inches in length.

19. A removable shaft member, according to claim 1, wherein said first portion of said second means formed on said first end portion of said shaft member for preventing lateral movement of such ball portion of such bearing assembly in such first predetermined direction includes a first elongated aperture having a first tapered end wall disposed facing said first end of said center portion of said shaft member and a first threaded aperture formed intermediate another end wall of said first elongated aperture and said first end of said center portion of said shaft member, said first elongated aperture receiving a portion of a first ball portion locking device therein and said first threaded aperture receiving a first bolt member therein to secure such first locking device to said first end portion of said shaft member.

20. A removable shaft member, according to claim 19, wherein said first portion of said third means formed on said second end portion of said shaft member for preventing lateral movement of such ball portion of such bearing assembly in such second predetermined direction includes a second elongated aperture having a second tapered end wall disposed facing said second end of said center portion of said shaft member and a second threaded aperture formed intermediate another end wall of said second elongated aperture and said second end of said center portion of said shaft member, said second elongated aperture receiving a second bolt member therein to secure such second locking device to said second end portion of said shaft member.

21. A removable shaft member, according to claim 1, wherein said shaft member further includes:

(a) a first shaft extension portion having each of a fourth predetermined length and a fifth predetermined diameter, said first shaft extension portion extending outwardly from an outer end of said first end portion and having a substantially flat face portion with a first predetermined width disposed adjacent an cuter end thereof; and (b) a second shaft extension portion having each of a fifth predetermined length and a sixth predetermined diameter, said second shaft extension portion extending outwardly from an outer end of said second end portion and having a substantially flat face portion with a second predetermined width disposed adjacent an outer end thereof.

22. A removable shaft member, according to claim 21, wherein at least one of said first shaft extension portion and said second shaft extension portion includes a threaded aperture formed in an outer face thereof and substantially centered at a longitudinal axis of said shaft member.

* * * * *

UNITED STATES PATENT AND TRADEMARK OFFICE

CERTIFICATE OF CORRECTION

PATENT NO. : 5,271,511

DATED : December 21, 1993

INVENTOR(S) : David Daugherty, Jr. et al.

It is certified that error appears in the above-indentified patent and that said Letters Patent is hereby corrected as shown below:

Column 4, line 9, delete "," after prior;

Column 4, line 10, delete "3,716,148" and insert —3,716,146—.

Column 7, line 21, delete the hyphen.

Column 9, line 45, insert —first— after said.

Column 10, line 5, insert —,— after means;

Signed and Sealed this

Twelfth Day of July, 1994

Bruce Lehman

*Attest:*

BRUCE LEHMAN

*Attesting Officer*

*Commissioner of Patents and Trademarks*